US009344804B2

(12) United States Patent
Chen et al.

(10) Patent No.: US 9,344,804 B2
(45) Date of Patent: May 17, 2016

(54) MINIATURE MOVING-COIL SPEAKER

(75) Inventors: Gang Chen, WeiFang (CN); Minghui Shao, WieFang (CN); Qing Miao, WeiFang (CN); Chao Xu, WeiFang (CN); Zongjun Mou, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 14/370,055

(22) PCT Filed: Feb. 20, 2012

(86) PCT No.: PCT/CN2012/071352

§ 371 (c)(1),
(2), (4) Date: Jun. 30, 2014

(87) PCT Pub. No.: WO2013/097330

PCT Pub. Date: Jul. 4, 2013

(65) Prior Publication Data

US 2014/0376766 A1 Dec. 25, 2014

(30) Foreign Application Priority Data

Dec. 30, 2011 (CN) ..... 2011 1 0455352

(51) Int. Cl.
*H04R 9/02* (2006.01)
*H04R 15/00* (2006.01)
(Continued)

(52) U.S. Cl.
CPC ..... *H04R 15/00* (2013.01); *H04R 1/06* (2013.01); *H04R 3/00* (2013.01); *H04R 9/02* (2013.01); *H04R 9/06* (2013.01); *H04R 2209/00* (2013.01); *H04R 2499/11* (2013.01)

(58) Field of Classification Search
USPC ..... 381/117, 396, 398, 400, 412, 420, 421
See application file for complete search history.

(56) References Cited

U.S. PATENT DOCUMENTS

2001/0053233 A1* 12/2001 Fukazawa et al. ..... 381/409
2005/0036646 A1* 2/2005 Garner et al. ..... 381/412
(Continued)

FOREIGN PATENT DOCUMENTS

CN 201131055 Y 10/2008
CN 201238375 Y 5/2009
(Continued)

OTHER PUBLICATIONS

International Search Report for PCT/CN2012/071352 filed on Feb. 20, 2012.
(Continued)

*Primary Examiner* — Ahmad F Matar
*Assistant Examiner* — Sabrina Diaz

(57) ABSTRACT

Disclosed is a miniature moving-coil speaker comprising a magnetic circuit system, a vibration system, and an auxiliary system for fixing the magnetic circuit system and the vibration system. The vibration system comprises a diaphragm and a voice coil integrated with the diaphragm. The auxiliary system comprises a plastic enclosure. The diaphragm is installed correspondingly at one end face of the enclosure, while the magnetic circuit system is installed at the other end face of the enclosure opposite the diaphragm; also: a flexible circuit board is arranged on the end face of the enclosure where the magnetic circuit system is installed, and the voice coil is electrically connected to the flexible circuit board. The design reduces product installation height, while at the same time facilitates wire-leading and wire-combing for the miniature moving-coil speaker, and simplifies product design.

9 Claims, 2 Drawing Sheets

(51) Int. Cl.

| | |
|---|---|
| ***H04R 9/06*** | (2006.01) |
| ***H04R 3/00*** | (2006.01) |
| ***H04R 1/06*** | (2006.01) |

(56) References Cited

U.S. PATENT DOCUMENTS

| | | | | |
|---|---|---|---|---|
| 2007/0274557 | A1 | 11/2007 | Chiba | |
| 2011/0235850 | A1* | 9/2011 | Lu | H04R 19/02 381/433 |
| 2011/0243371 | A1* | 10/2011 | Xu | 381/433 |
| 2012/0170793 | A1* | 7/2012 | Jiang et al. | 381/412 |
| 2013/0077816 | A1* | 3/2013 | Her et al. | 381/412 |

FOREIGN PATENT DOCUMENTS

| | | | |
|---|---|---|---|
| CN | 201307929 | Y | 9/2009 |
| CN | 201657283 | U | 11/2010 |
| KR | 20-2011-0002044 | U | 3/2011 |
| WO | WO 2011/059142 | A1 | 5/2011 |

OTHER PUBLICATIONS

Chinese Office Action for Application No. 201110455352.2, dated Apr. 1, 2014.

* cited by examiner

MINIATURE MOVING-COIL SPEAKER

TECHNICAL FIELD

The invention relates to the technical field of electro-acoustic conversion, and more particularly to a miniature moving-coil speaker.

BACKGROUND

With the rapid development of the consumer electronics market, a large number of miniature electro-acoustic components such as miniature moving-coil speakers are widely used. As the portable design of terminal products is requiring higher product performance, the design improvement of thinness and miniaturization is also required at the same time.

In conventional design, a miniature moving-coil speaker is usually connected to the terminal electronics electrically by soldering wires directly or by using a rigid PCB. However, such design can generally be only arranged at a side of the product due to restraints on product installation height, and the wire-leading of the miniature moving-coil speaker is routed according to product performance and connection terminal position.

However, such design not only increases overall dimensions of the product, but also interferes with miniaturization design of the product. Meanwhile, the wiring of the miniature moving-coil speaker also needs to be adjusted accordingly due to restraints on the connection terminal position and requirements on product performance of the miniature moving-coil speaker, which increases the difficulty of product design.

Therefore, it is necessary to improve the existing miniature moving-coil speaker to avoid the above drawbacks.

SUMMARY

Technical Problem

The technical problem sought to be solved by the present invention is to provide a miniature moving-coil speaker capable of reducing the whole size of the product, reducing product installation height, while at the same time, facilitating wire-leading and wire-combing for the miniature moving-coil speaker, and simplifying product design.

Technical Solution

In order to achieve the above goals, the present invention adopts the following technical solution: a miniature moving-coil speaker comprising a magnetic circuit system, a vibration system, and an auxiliary system for fixing the magnetic circuit system and the vibration system. The vibration system comprises a diaphragm and a voice coil integrated with the diaphragm. The auxiliary system comprises an enclosure made of plastic. The diaphragm is installed correspondingly at one end face of the enclosure, while the magnetic circuit system is installed at the other end face of the enclosure opposite the diaphragm. Also: a flexible circuit board is arranged on the end face of the enclosure where the magnetic circuit system is installed, and the voice coil is electrically connected to the flexible circuit board.

As an improvement, the magnetic circuit system projects over the end face of the enclosure, and the flexible circuit board is loop-shaped.

As an improvement, a part of the flexible circuit board bends along the side wall of the miniature moving-coil speaker and is fixed on the side wall of the enclosure.

As an improvement, a fixation post is provided on the side wall of the enclosure, and a first fixing hole corresponding to the fixation post is provided on the flexible circuit board.

As an improvement, a heat stake is provided on the end face of the enclosure on which the flexible circuit board is installed, and a second fixing hole corresponding to the heat stake is provided on the flexible circuit board.

As an improvement, the enclosure has a quadratic structure, the flexible circuit board is provided with two pairs of pads which are provided on the two axes opposite to each other at the enclosure, and the two pairs of pads are electrically connected through the circuit in the flexible circuit board.

As an improvement, the flexible circuit board is provided at the short axis side of the enclosure, and a part of the flexible circuit board is bent and fixed on the long axis side of the enclosure.

As an improvement, the magnetic circuit system comprises an inner magnet in the middle and two bar-type outer magnets arranged along the long axes, the outer magnets are fixed on the long axes of the enclosure; and the flexible circuit board is fixed on the magnetic circuit system.

Advantageous Effects of Invention

With the above technical solution, the miniature moving-coil speaker of the present invention can reduce the product installation height by providing a flexible circuit board on the bottom surface of the enclosure away from the diaphragm; meanwhile the structure and the position of the electrical connection of the flexible circuit board can be adjusted according to actual demands, thereby facilitating the wire-leading and wire-combing of the miniature moving-coil speaker and simplifying product design.

DETAILED DESCRIPTION OF THE EMBODIMENTS

The detailed structure of the present invention will be described in connection with the attached drawings.

Embodiment

Figure 1:
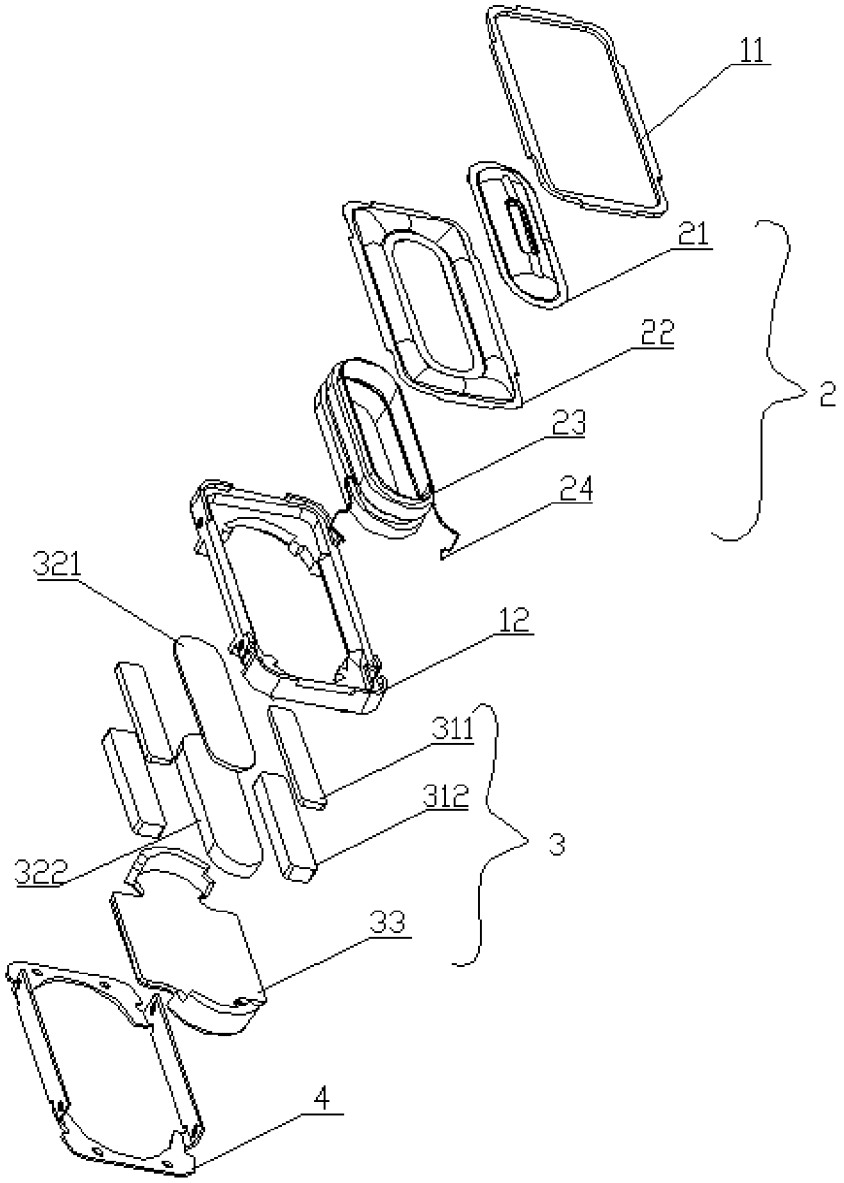
FIG. 1 is an exploded schematic view illustrating the miniature moving-coil speaker according to the present invention.
Figure 2:
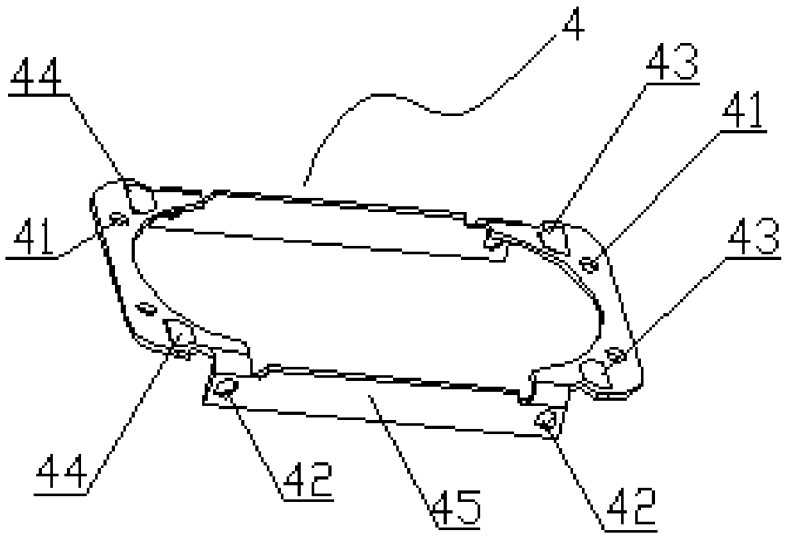
FIG. 2 is a perspective view illustrating the FPCB of the miniature moving-coil speaker according to the present invention.
Figure 3:
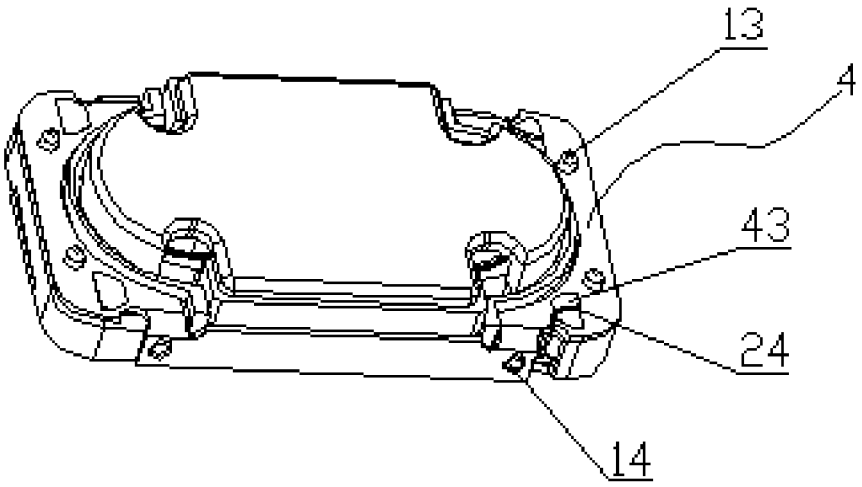
FIG. 3 is a perspective view illustrating the FPCB assembled with the enclosure according to the present invention.

Please refer to FIGS. 1 to 3, the miniature moving-coil speaker of the present invention comprises a magnetic circuit system 3, a vibration system 2, and an enclosure 12 for fixing the magnetic circuit system 3 and the vibration system 2. The vibration system 2 comprises a diaphragm and a voice coil 23 integrated with the diaphragm. The diaphragm is arranged correspondingly on one end face of the enclosure 12, and the bottom surface of the enclosure 12 away from the diaphragm is provided with a flexible circuit board 4 which is electrically connected with a lead wire 24 on the voice coil 23.

With the design of providing the flexible circuit board 4 on the bottom surface of the enclosure 12 on which the magnetic circuit system 3 is installed, the installation height of the whole product can be reduced. Meanwhile, the structure and the position of the electrical connection of the flexible circuit board 4 can be adjusted according to actual demands such as the outgoing line position of the lead wire 24 and the electrical connection of the end products, thereby facilitating the wire-leading and wire-combing of the miniature moving-coil speaker and simplifying product design.

In the present embodiment, it is preferable that the magnetic circuit system 3 projects over the end face of the enclosure 12, the flexible circuit board 4 is loop-shaped and the magnetic circuit system 3 projects over the bottom surface of the enclosure 12, which facilitates saving installation space in practical use of the miniature moving-coil speaker.

In the present embodiment, it is preferable that a part of the flexible circuit board 4 bends along the side wall of the enclosure 12 of the miniature moving-coil speaker and is fixed on the side wall of the enclosure 12. Such design facilitates fixation and assembly between the flexible circuit board 4 and the enclosure 12, and saves installation space of the flexible circuit board 4 at the same time.

In the present embodiment, the flexible circuit board 4 has a loop-shaped structure, which comprises a first fixing hole 41, a second fixing hole 42, a first group of pads 43 and a second group of pads 44 each group having a pair of pads. The flexible circuit board 4 can be combined with the enclosure 12 by gluing, mechanical coupling etc., wherein the first fixing hole 41 is assembled with and fixed to a fixation post 14 on the side wall of the enclosure 12, and the second fixing hole 42 is combined and fixed together by heat melting with a heat stake 13 on the bottom surface of the enclosure 12. Also, the first and second groups of pads 43 and 44 are provided on two axes opposite to each other at the bottom surface of the enclosure 12, and the two pairs of pads are electrically connected through the inner circuit of the flexible circuit board 4, more particularly in the case that the leading-out terminal of the lead wire 24 locates at a different position from the connection terminal of the miniature moving-coil speaker.

Also, the miniature moving-coil speaker in the present embodiment has a quadratic structure, which comprises a liner ring 11 made from plastic material, and the liner ring 11 is located at the upper side of the diaphragm where the diaphragm is combined with the enclosure 12. The diaphragm comprises a central portion 21 at the center and a hollow loop-shaped surrounding portion 22. The central portion 21 and the surrounding portion 22 are combined together and enclose one end of the enclosure 12. The magnetic circuit system comprises an outer magnetizer plate 311 and a outer magnet 312, and an inner magnetizer plate 321 and an inner magnet 322, which are combined together with a frame 33 sequentially from up to down, wherein the outer magnetizer plate 311 and the outer magnet 312 have a bar-shaped structure, and are provided on the long axes sides of the inner magnetizer plate 321 and the inner magnet 322 respectively. The part 45 of the flexible circuit board 4 bending onto the side wall of the enclosure 12 is fixed on the magnetic circuit system 3, by which the dimension of the miniature moving-coil speaker is reduced and the electrical connection of the flexible circuit board 4 is also achieved at the same time.

In the present embodiment, the moving-coil speaker may also be circular or of other structure, the end face of the miniature moving-coil speaker on which the magnetic circuit system is installed may also be flat, i.e., the magnetic circuit system is wrapped by the enclosure, and the flexible circuit board is wholly provided on the end face of the miniature moving-coil speaker, and these features do not adversely affect the implementation of the present invention.

The abovementioned are only embodiments of the invention and are not for restricting the present invention, thus the equivalent modifications or variations made by those skilled in the art according to the present invention should be regarded as in the protection scope specified in the claims.

The invention claimed is:

1. A miniature moving-coil speaker comprising:

a magnetic circuit system;

a vibration system; and an enclosure fixing the magnetic circuit system and the vibration system, wherein the vibration system comprises a diaphragm and a voice coil coupled with the diaphragm, the diaphragm being fixed and installed at an end face of the enclosure, wherein a flexible circuit board is arranged on a bottom surface of the enclosure away from the diaphragm, and the voice coil is electrically connected to the flexible circuit board, wherein the magnetic circuit system projects over the end face of the enclosure, and the flexible circuit board is loop-shaped such that the magnetic circuit system projects through the loop-shaped flexible circuit board, and the flexible circuit board surrounds the magnetic circuit system, and wherein a part of the flexible circuit board bends along a side wall of the enclosure and is fixed on the side wall of the enclosure.

2. The miniature moving-coil speaker according to claim 1, wherein a fixation post is provided on the side wall of the enclosure, and a first fixing hole corresponding to the fixation post is provided on the part of the flexible circuit board.

3. The miniature moving-coil speaker according to claim 1, wherein a heat stake is provided on the bottom surface of the enclosure on which the flexible circuit board is installed, and a second fixing hole corresponding to the heat stake is provided on the flexible circuit board.

4. The miniature moving-coil speaker according to claim 1, wherein the enclosure has a quadratic structure, the flexible circuit board is provided with two pairs of pads which are provided on two axes opposite to each other at the enclosure, and the two pairs of pads are electrically connected through a circuit in the flexible circuit board.

5. The miniature moving-coil speaker according to claim 4, wherein the flexible circuit board is provided at a short axis side of the enclosure, and the part of the flexible circuit board is bent along and fixed on a long axis side of the enclosure.

6. The miniature moving-coil speaker according to claim 1, wherein the magnetic circuit system comprises an inner magnet in the middle and two bar-shaped outer magnets extending along a long axis of the inner magnet, and the part of the flexible circuit board bending onto the side wall of the enclosure is fixed on the magnetic circuit system.

7. The miniature moving-coil speaker according to claim 1, wherein the flexible circuit board includes first and second pairs of pads, the first pair of pads being arranged along a first direction, the second pair of pads being arranged along the first direction, each of the first pair of pads being spaced apart from a corresponding one of the second pair of pads in a second direction perpendicular to the first direction.

8. A miniature moving-coil speaker comprising:

an enclosure;

a magnetic circuit system disposed in the enclosure;

a vibration system including a diaphragm and a voice coil coupled to the diaphragm, the diaphragm being fixed to a face of the enclosure; and a loop-shaped flexible circuit board electrically coupled to the voice coil and attached to outer surfaces of the enclosure, wherein the magnetic circuit system is disposed within a space defined by the loop of the loop-shaped flexible circuit board, and a portion of the magnetic circuit system protrudes from the loop, and wherein the magnetic circuit system protrudes from the loop of the loop-shaped flexible circuit board in a first direction, and sidewalls of the flexible circuit board extend from the loop of the loop-shaped flexible circuit board in a second direction opposite to the first direction.

9. The miniature moving-coil speaker of claim 8, wherein the outer surfaces of the enclosure to which the loop-shaped flexible circuit board is attached are on an opposite side of the enclosure from the diaphragm.

* * * * *